US009071023B2

(12) United States Patent
Kondo

(10) Patent No.: US 9,071,023 B2
(45) Date of Patent: Jun. 30, 2015

(54) DEVICE CONNECTOR

(71) Applicant: Sumitomo Wiring Systems, Ltd., Yokkaichi, Mie (JP)

(72) Inventor: Tomoyuki Kondo, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 257 days.

(21) Appl. No.: 13/721,881

(22) Filed: Dec. 20, 2012

(65) Prior Publication Data

US 2013/0189879 A1 Jul. 25, 2013

(30) Foreign Application Priority Data

Jan. 19, 2012 (JP) ..... 2012-009135

(51) Int. Cl.

| | |
|---|---|
| ***H01R 9/03*** | (2006.01) |
| ***H01R 13/648*** | (2006.01) |
| ***H01R 9/18*** | (2006.01) |
| ***H01R 13/6581*** | (2011.01) |
| ***H01R 13/74*** | (2006.01) |
| *H01R 13/504* | (2006.01) |
| *H01R 13/512* | (2006.01) |
| *H01R 13/6593* | (2011.01) |

(52) U.S. Cl.

CPC ..... *H01R 13/648* (2013.01); *H01R 9/03* (2013.01); *H01R 9/18* (2013.01); *H01R 13/504* (2013.01); *H01R 13/512* (2013.01); *H01R 13/6581* (2013.01); *H01R 13/6593* (2013.01); *H01R 13/748* (2013.01); *H01R 2201/26* (2013.01)

(58) Field of Classification Search

USPC ..... 439/607.44, 607.41, 607.45, 439/607.48–607.5, 607.53, 607.55, 620.1, 439/620.19, 607.28, 607.01, 626

See application file for complete search history.

(56) References Cited

U.S. PATENT DOCUMENTS

| | | | | |
|---|---|---|---|---|
| 7,572,150 | B2 * | 8/2009 | Matsuoka | 439/626 |
| 8,545,265 | B2 * | 10/2013 | Sakamoto et al. | 439/606 |
| 8,672,700 | B2 * | 3/2014 | Matsumoto et al. | 439/364 |
| 2006/0063444 | A1 | 3/2006 | Akuzawa et al. | |
| 2009/0025974 | A1 | 1/2009 | Chen et al. | |
| 2010/0046189 | A1 * | 2/2010 | Hasegawa et al. | 361/816 |
| 2010/0216323 | A1 * | 8/2010 | Kawamura et al. | 439/95 |
| 2011/0235977 | A1 * | 9/2011 | Yamada | 385/76 |

FOREIGN PATENT DOCUMENTS

| | | |
|---|---|---|
| WO | 2013015396 | 1/2013 |

* cited by examiner

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A device connector includes a first housing (20) accommodating first terminals (30) connected to terminals of a device and a second housing (40) accommodating second terminals (55) connected to ends of wires (50) and connectable to the first housing (20). Connecting portions (31, 56) of the first and second terminals (30, 55) are placed one over the other and bolted as the housings (20, 40) are connected. The first housing (20) has a work hole (34) for bolting the connecting portions (31, 56) of the terminals (30, 55) together. A metal shield shell (60) covers the connected housings (20, 40) and is bolted to a case (10) at three mounting portions (65, 66) and (97) arranged on an outer part of the shield shell (60) to form a triangle having substantially equal sides.

8 Claims, 6 Drawing Sheets

DEVICE CONNECTOR

BACKGROUND OF THE INVENTION

1. Field of the Invention

The invention relates to a device connector having a shielding function.

2. Description of the Related Art

U.S. Pat. No. 7,572,150 discloses a device connector with a shielding function. This device connector is connected to a terminal of a device housed in a metal case and includes a first housing accommodating a first terminal connected to the device-side terminal and a second housing accommodating a second terminal connected to an end of a wire and connectable to the first housing. Connecting portions of the first and second terminals are placed one over the other as the two housings are connected and are bolted together through a work hole formed in the first housing. A shell cover is mounted to cover connected parts of the two housings including the work hole and is bolted to a metal plate attached to the upper surface of the case to fulfill a shielding function. Enhanced shielding performance without drastic shape changes would well received The invention was completed in view of the above situation.

SUMMARY OF THE INVENTION

The invention relates to a device connector to be connected to at least one terminal of a device housed in a conductive case. The device connector has a first housing accommodating at least one first terminal to be connected to the terminal of the device and a second housing accommodating at least one second terminal to be connected to an end of a wire and connectable to the first housing. Connecting portions of the first and second terminals are placed one over the other and are bolted as the two housings are connected. The first housing is formed with at least one work hole used to bolt the connecting portions of the terminals together. A shield shell made of conductive material is arranged to at least partly cover the connected housings is provided and has three mounting portions to be fixed to the case by bolting. The three mounting portions are arranged to form a triangle having substantially equal sides. Electromagnetic wave noise generated in the housings is absorbed by the shield shell and transferred to the case from the mounting portions at three positions.

The three mounting portions preferably are arranged on an outer edge part of the shield shell and are disposed so that a ratio of the longest side to the shortest side is about 1.8 or less. Preferably, the triangle has substantially equal sides. Thus, electromagnetic wave noise is transferred efficiently to the case so that high shielding performance can be obtained.

Shielding performance can be improved by making only a relatively simple structural change such as a change in the number and arrangement of the mounting positions of the shield shell to the case.

The shield shell preferably has a shell main body for covering connected parts of the two housings and a shell cover for covering the work hole while partly overlapping the shell main body.

The shell main body and the shell cover preferably are joined by bolting.

The shell main body preferably has two of the mounting portions and the shell cover preferably has one of the mounting portions.

Convex/concave engaged positioning portions are provided between the shell main body and the shell cover to position the shell main body and the shell cover and prevent the shell main body and the shell cover from being rotated or displaced when bolting is performed. A shield shell assembling operation can be performed efficiently.

The shell cover preferably is made of a metal plate and formed by integrally joining the separately formed cover main body and mounting portion by welding. The cover main body preferably is made of a thinner material than the mounting portion.

A case of a device may be divided in two and the two mounting portions of the shell main body and the one mounting portion of the shell cover may be bolted respectively to different cases. The heights of mounting surfaces of the cases may be displaced within a tolerance. However, the cover main body with a small plate thickness and relatively low flexural rigidity takes up the tolerance while being deformed. On the other hand, the thicker more rigid mounting portion has strength to withstand vibration.

The mounting portion preferably is reinforced by being formed with at least one side wall and/or at least one raised portion.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
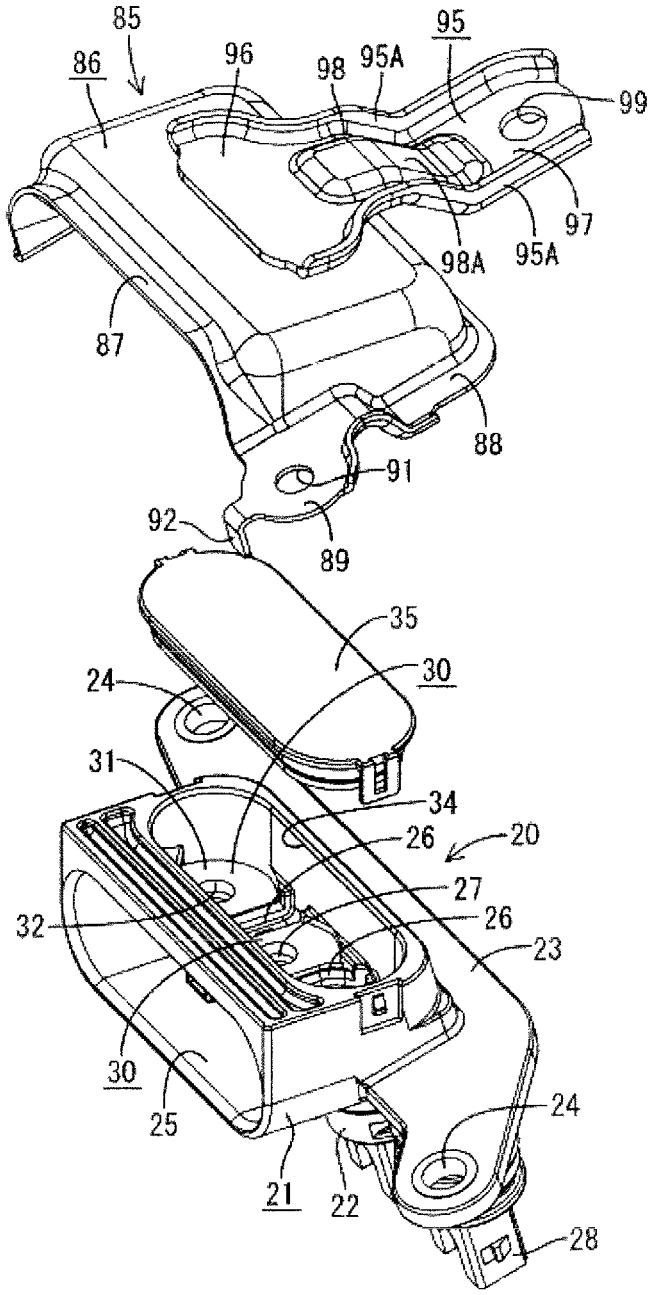
FIG. 1 is an exploded perspective view of a first housing according to one embodiment of the invention.
Figure 2:
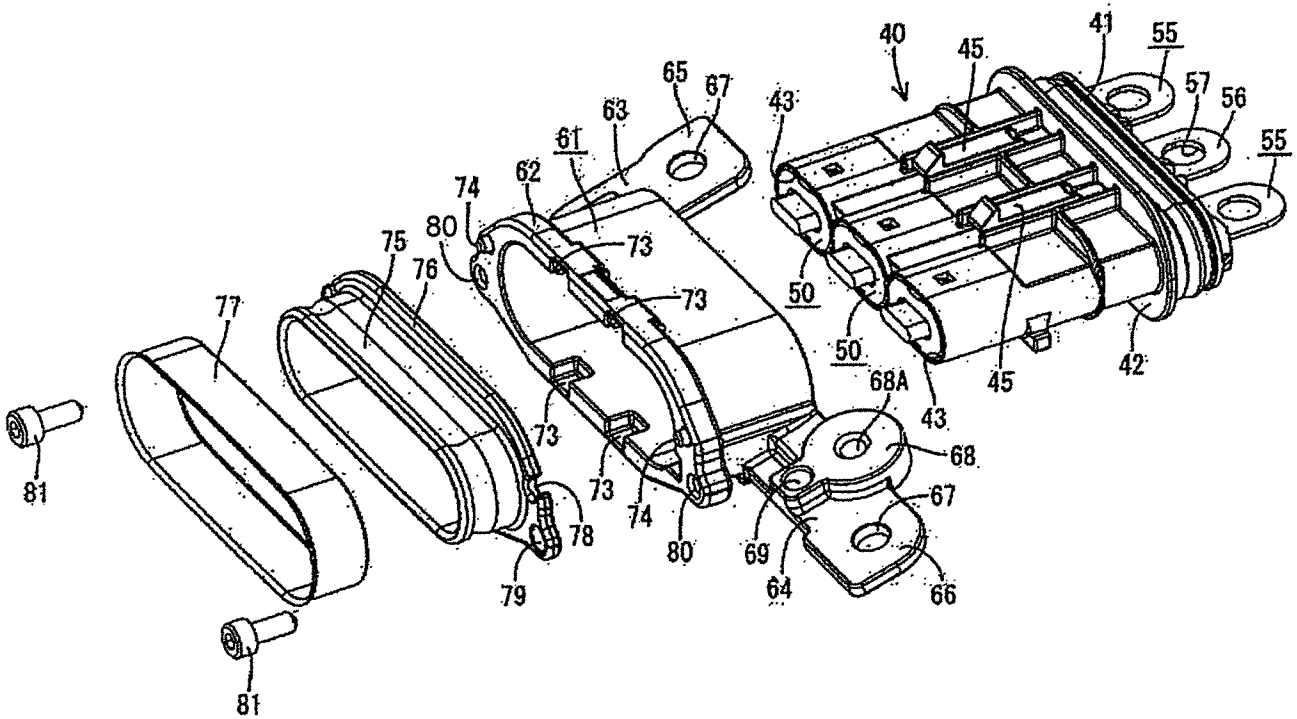
FIG. 2 is an exploded perspective view of a second housing.
Figure 3:
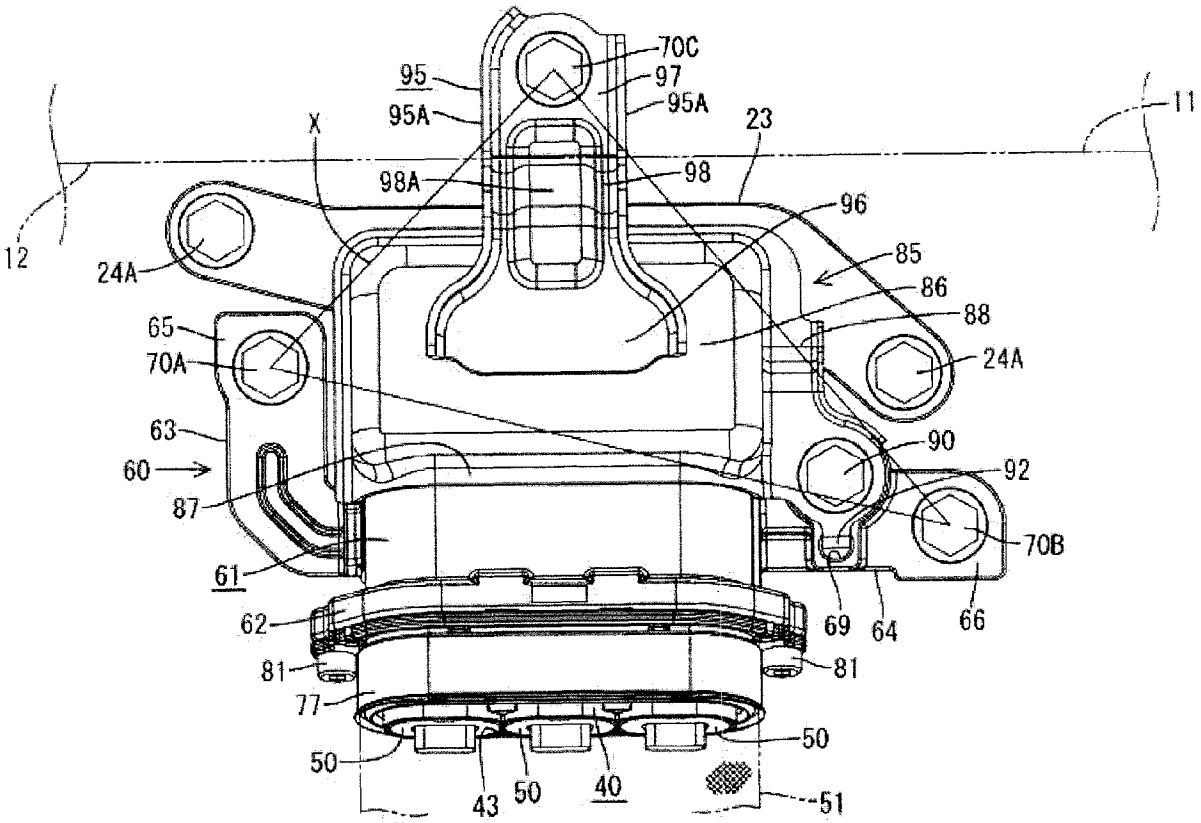
FIG. 3 is a plan view of a connector mounted to a case.
Figure 4:
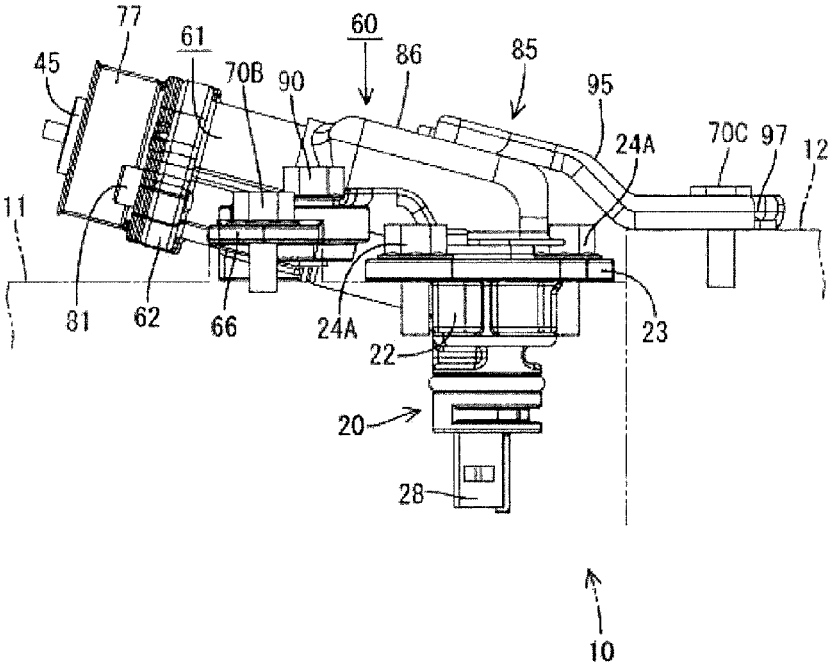
FIG. 4 is a right side view of the connector of FIG. 3.
Figure 5:
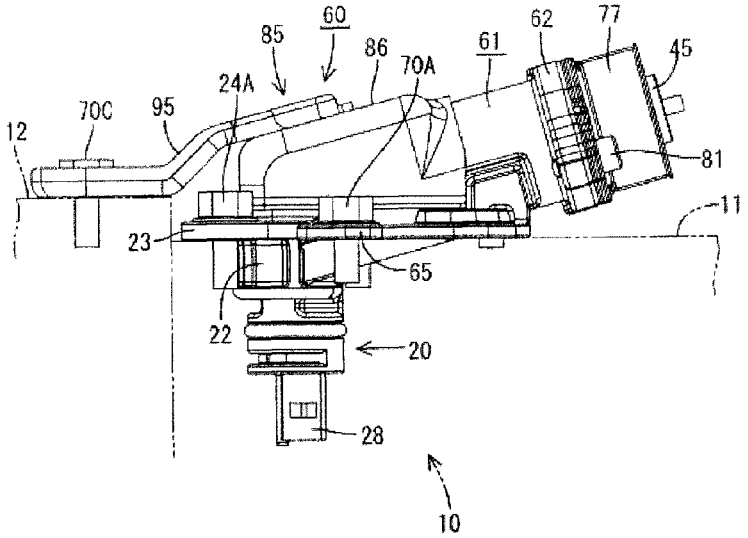
FIG. 5 is a left side view of the connector of FIG. 3.
Figure 6:
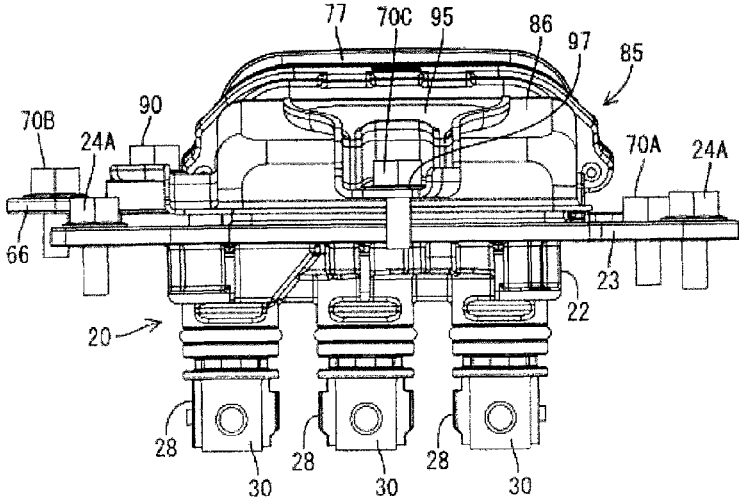
FIG. 6 is a rear view of the connector of FIG. 3.

FIGS. 1 to 7 illustrate a device connector that is to be arranged at a part connecting a generator and an inverter of a hybrid vehicle and specifically where a shielded cable drawn out from the inverter is connected to the generator. The generator is housed and shielded in a conductive metal case. As shown in FIGS. 3 to 5, the case 10 comprises separate first and second cases 11 and 12 arranged side by side.

The connector includes a device-side first housing 20 to be mounted on the upper surface of the first case 11 and a cable-side second housing 40 connected to an end of the shielded cable drawn out from or connected to the inverter.

The first housing 20 is made e.g. of synthetic resin. As shown in FIGS. 1 and 4, the first housing 20 includes a wide box-shaped housing main body 21 and a fitting body 22 projecting at an obtuse angle from the lower surface of a back side of the housing main body 21. The fitting body 22 can be fit into a mounting hole in the upper surface of the first case 11. A flange 23 is formed on a base end part of the fitting body 22, and mounting holes 24 are formed on left and right end parts of the flange 23. The first housing 20 is to be mounted with the flange 23 placed on the upper surface of the first case 11 so that the housing main body 21 faces obliquely up to the front.

Figure 7:
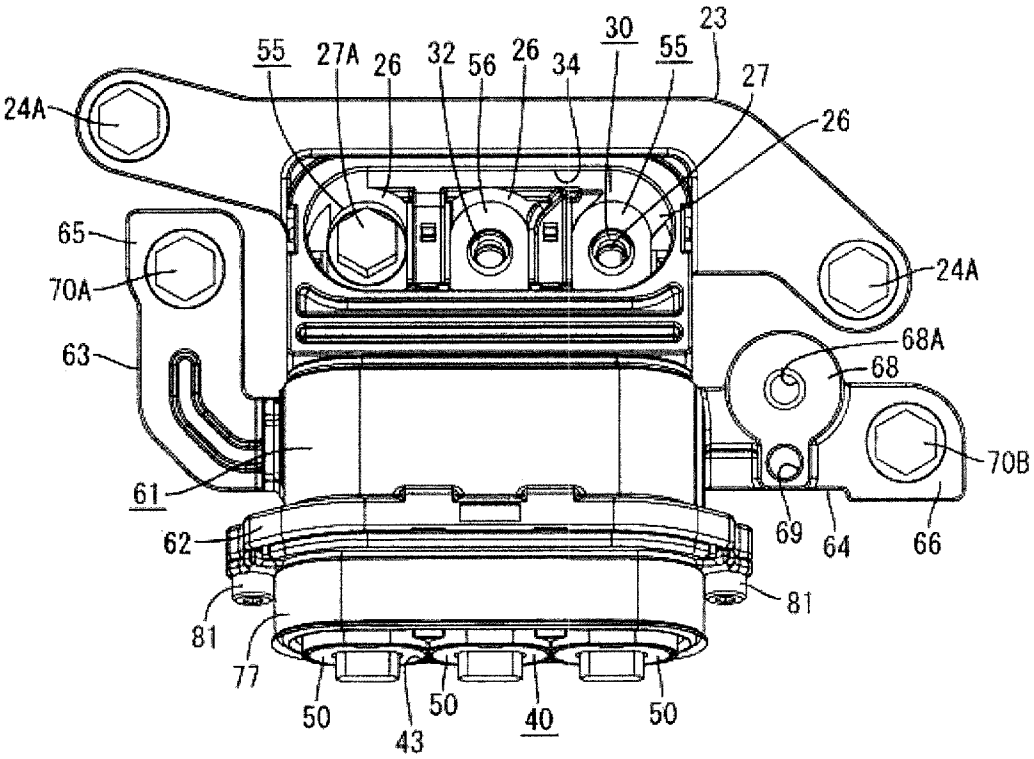
FIG. 7 is a plan view showing a state with a shell cover and a cap removed.

A fitting hole 25 is formed in the front wall of the housing main body 21 for receiving the second housing 40. As also shown in FIG. 7, three terminal blocks 26 are juxtaposed laterally in the housing main body 21 and nuts 27 are fit on the upper surfaces thereof. Legs 28 on lower ends of the terminal blocks 26 project from the lower surface of the fitting body 22.

A first terminal 30 is to be mounted on each terminal block 26. The first terminal 30 is vertically long and has an upper end bent at a substantially right angle to form a connecting portion 31 with an insertion hole 32. The first terminal 30 is mounted by insert molding so that the connecting portion 31 can be placed on the upper surface of the corresponding terminal block 26 and the first terminal 30 extends substantially along the leg 28 through the fitting body 22.

The lower end of each first terminal 30 is to be connected by bolting or the like to a corresponding terminal (not shown) of the generator housed in the case 10.

A work hole 34 is formed in the ceiling wall of the housing main body 21 above the terminal blocks 26. The work hole 34 is used to fasten the connecting portions 31 of the first terminals 30 and connecting portions 56 of the second terminals 55 by bolts 27A on the terminal blocks 26. A one cap 35 made of synthetic resin is mounted removably into this work hole 34 in a fluid- or watertight manner.

The second housing 40 also is made e.g. of synthetic resin. As shown in FIG. 2, the second housing 40 is a substantially flat block. A fitting 41 is formed on a the rear part of the second housing 40 and is to be fit in a fluid- or watertight manner into the fitting hole 25 of the first housing 20, and a flange 42 is formed on a base end of the fitting 41.

Three cavities 43 are juxtaposed laterally in the second housing 40 and open at both front and rear surfaces of the second housing 40. A second terminal 55 is accommodated in each cavity 43 and is to be connected to an end of a shielded cable.

The shielded cable is of a collective type with three insulated wires 50 provided in a sheath (not shown) with a braided wire 51 fit around them. The three insulated wires 50 are exposed by stripping an end of the sheath, and the second terminal 55 is connected to an end of each exposed insulated wire 50.

The second terminal 55 is long and narrow in forward and backward directions and a connecting portion 56 including an insertion hole 57 is formed on a leading end part thereof. The second terminal 55 is fixed by crimping and connecting at least one barrel (not shown) on the rear end thereof to the end of the insulated wire 50.

The three second terminals 55 are inserted into corresponding cavities 43 of the second housing 40 e.g. from the front and the insertion is stopped when the connecting portion 56 on the leading end projects a specified distance from the rear surface of the fitting 41.

The fitting 41 of the second housing 40 in which the second terminals 55 are mounted is fit into the fitting hole 25 of the first housing 20. The connecting portions 56 on the leading ends of the respective second terminals 55 are aligned on the upper surfaces of the connecting portions 31 of the first terminals 30 on the terminal blocks 26 when the fitting 41 is pushed to a position where the flange 42 contacts the opening edge of the front surface of the fitting hole 25.

A shield shell 60 is mounted to at least partly cover the connected housings 20, 40. The shield shell 60 is composed of a shell main body 61 and a shell cover 85.

The shell main body 61 is made of a conductive material such as aluminum die-cast and/or formed to have a substantially tubular shape capable of covering a specified length area of the second housing 40 before the flange 42, as shown in FIG. 2. A thick mounting ring 62 is formed on the front edge of the shell main body 61.

Left and right mounting arms 63, 64 used to mount the shell main body 61 on the upper surface of the first case 11 project from the left and right surfaces of the shell main body 61. Specifically, the left mounting arm 63 is bent back substantially at a right angle after slightly projecting to the left as shown in FIG. 3. The extending end of the left mounting arm 63 defines a first mounting portion 65 to be mounted on the case 10 and the first mounting portion 65 is formed with an insertion hole 67 for a bolt 70A.

The right mounting arm 64 projects substantially straight to the right at a position a specified distance above the left mounting arm 63, and the projecting end thereof defines a second mounting portion 66 to be mounted on the case 10. The second mounting portion 66 similarly has an insertion hole 67 for a bolt 70B.

A slightly elevated coupling 68 to the shell cover 85 is formed at an intermediate position of the right mounting arm 64. The coupling 68 is formed with a screw hole 68A and a positioning hole 69 is adjacent to the screw hole 68A.

The shell main body 61 is fit into the second housing 40 from the front and mounted at a specified position on the outer peripheral surface of the second housing 40 by the resilient engagement of two locking pieces 45 provided on each of the upper and lower surfaces with locking holes 73 formed on upper and lower inner surfaces of the mounting ring 62 when the rear edge of the shell main body 61 contacts the flange 42.

A bracket 75 is mounted removably on the front surface of the shell main body 61 for fixing an open end of the braided wire 51 in the shielded cable. The bracket 75 is made of conductive material, such as aluminum die-cast, and is substantially in the form of a short tube having the same diameter as the second housing 40, and a mounting plate 76 is formed on the rear edge to project like a flange. The opening part of the braided wire 51 is fit on the bracket 75 and fixed by a crimp ring 77.

The bracket 75 is fixed by placing the mounting plate 76 on the front surface of the mounting ring 62 while engaging positioning recesses 78 formed by cutting the left and right edges of the mounting plate 76 with positioning pins 74 projecting from the front surface of the mounting ring 62 and tightening screws 81 inserted through insertion holes 79 formed on left and right edges of the mounting plate 76 into screw holes 80 formed on the front surface of the mounting ring 62.

As shown in FIG. 1, the shell cover 85 comprises a cover main body 86 and a mounting arm 95 that are made of a conductive material, such as metal plate and may be formed press working a steel plate as a base material into a specified shape and then applying tin plating. However, the base material (steel plate) used for the cover main body 86 is thinner the base material for the mounting arm 95.

The cover main body 86 is formed to have a saucer shape including a front opening 87 and can at least partly cover the upper surface of the first housing 20. An overlapping portion 88 is formed on the front opening 87 and is to be placed on the upper surface of the rear end part of the shell main body 61 described above.

A placing edge 88 projects on the lower edge of the cover main body 86 at rear parts of the left and right surfaces and the rear surface. The placing edge 88 can be placed on the upper surface of a base end of the flange 23 of the first housing 20. A slightly elevated engaging portion 89 is formed at an end of the cover main body 86 before the wide right end of the placing edge 88 and can be placed on the coupling 68 provided on the right mounting arm 64 of the shell main body 61. The engaging portion 89 is formed with an insertion hole 91 for a bolt 90.

A positioning piece 92 is provided on the front edge of the coupling 68 and defines of a downward extending hook to be fit into the positioning hole 69. Specifically, the insertion hole 91 and the screw hole 68A are aligned concentrically when the engaging portion 89 is placed on the coupling 68 while the positioning piece 92 is fit into the positioning hole 69.

A wide connecting portion 96 is formed on a front end of the mounting arm 95, and a narrow third mounting portion 97 is formed on a rear end at a lower position to form a step, as shown in FIG. 3. The connecting portion 96 and the third mounting portion 97 are coupled by an incline 98. The third mounting portion 97 is to be mounted on the upper surface of the second case 12 and has an insertion hole 99 for a bolt 70C. The mounting arm 95 is reinforced against bending by side walls 95A that project up on left and right sides of the mounting arm 95 and by a raised portion 98A embossed in the inclined portion 98.

The connecting portion 96 is placed on a central part of the upper surface of the cover main body 86 with the third mounting portion 97 extending back. The mounting arm 95 then is fixed by welding or soldering so that the cover main body 86 and the mounting arm 95 are united to form the shell cover 85. The third mounting portion 97 projects a specified distance from the rear edge of the cover main body 86.

The first housing 20 is placed on a specified position of the upper surface of the first case 11. The bolts 24A then are inserted through the mounting holes 24 on the opposite ends of the flange 23 and screwed into the screw holes on the upper surface of the first case 11 to fix the first housing 20 with the fitting hole 25 on the front surface of the housing main body 21 facing obliquely up, as shown in FIG. 4.

At the same time, the lower ends of the first terminals 30 mounted on the respective terminal blocks 26 are connected to the corresponding terminals of the generator.

On the other hand, the end processing described above is applied to the shielded cable, i.e. the end of the sheath is stripped to expose the insulated wires 50 and the end of the braided wire 51, and the second terminals 55 are connected to the exposed ends of the respective insulated wires 50 by crimping, soldering or the like.

Particularly at the same time, the end of the shielded cable at least partly is inserted into the crimp ring 77, the bracket 75, the shell main body 61 of the shield shell 60 in advance.

In this state, the each second terminal 55 is inserted into the corresponding cavity 43 of the second housing 40 until the connecting portion 56 projects a specified distance from the rear surface of the fitting 41.

The already mounted shell main body 61 then is fit on the second housing 40. The locking pieces 45 resiliently engage the corresponding locking holes 73 on the inner surface of the mounting ring portion 62 when the rear edge of the shell main body 61 contacts the flange 42. Thus, the shell main body 61 is mounted at the specified position before the flange 42 on the outer peripheral surface of the second housing 40.

At the same time, the mounting plate 76 on the rear edge of the bracket 75 is placed on the front surface of the mounting ring 62 of the shell main body 61 and is fastened at left and right positions by the screws 81.

In this state, the opening part of the end of the braided wire 51 (FIG. 3) is fit on the outer peripheral surface of the bracket 75 and the crimp ring 77 is fit on that outer peripheral surface and crimped. Thus, the opening part of the end of the braided wire 51 is fixed to the outer peripheral surface of the bracket 75.

As a result, the second terminals 55 connected to the ends of the insulated wires 50 are mounted in the second housing 40, the shell main body 61 is mounted on the outer periphery of the second housing 40, and the opening of the end of the braided wire 51 is fit on the bracket 75 mounted on the front surface of the shell main body 61.

The fitting 41 on the rear surface of the second housing 40 connected to the end of the shielded cable together with the shell main body 61 is fit into the fitting hole 25 of the first housing 20 that has been mounted on the upper surface of the first case 11. The fitting 41 is pushed until the flange 42 contacts the opening edge of the front surface of the fitting hole 25. Thus, the first and second mounting portions 65, 66 on the left and right sides of the shell main body 61 are placed on specified positions of the upper surface of the first case 11 and the insertion holes 67 of the respective mounting portions 65, 66 align with the screw holes formed on the upper surface of the first case 11. The shell main body 61 then is fixed to the upper surface of the first case 11 by inserting the bolts 70A, 70B through the respective insertion holes 67 of the first and second mounting portions 65, 66 and screwing them into the corresponding screw holes.

At this time, the connecting portions 56 at the leading ends of the second terminals 55 mounted in the second housing 40 simultaneously are aligned with and placed on the upper surfaces of the connecting portions 31 of the first terminals 30 arranged on the terminal blocks 26 in the first housing 20.

In this state, the bolt 27A is inserted through the insertion holes 32, 57 of the connecting portions 31, 56 of the first and second terminals 30, 55 placed on each terminal block 26 and threadedly engaged with the fitted nut 27 to connect the corresponding first and second terminals 30, 55. The work hole 34 then is closed with the cap 35.

The cover main body 86 of the shell cover 85 then is mounted to cover the upper surface of the first housing 20 including the cap 35 while the positioning piece 92 is inserted into the positioning hole 69 of the shell main body 61. At this time, the overlapping portion 88 on the front edge of the cover main body 86 is placed on the upper surface of the rear part of the shell main body 61. Additionally, the engaging portion 89 of the cover main body 86 is placed on the coupling 68 of the shell main body 61 with the insertion hole 91 and the screw hole 68A aligned. The bolt 90 then is inserted through the insertion hole 91 and screwed to fasten the coupling portion 68 and the engaging portion 89 so that the shell main body 61 and the shell cover 85 are connected electrically and united to form the shield shell 60. The positioning piece 92 in the positioning hole 69 prevents rotation or displacement of the shell cover 85 while tightening the bolt 90 so that a bolt tightening operation is performed reliably and efficiently.

At this time, the third mounting portion 97 of the mounting arm 95 of the shell cover 85 is placed at a specified position of the upper surface of the second case 12 substantially arranged side by side with the first case 11 and the insertion hole 99 in the third mounting portion 97 is aligned with the screw hole on the upper surface of the second case 12.

The bolt 70C then is inserted through the insertion hole 99 of the third mounting portion 97 and screwed into the corresponding screw hole to fix the mounting arm 95 of the shell cover 85 to the upper surface of the second case 12.

In an assembled state, the first and second housings 20, 40 are connected and fixed to the first case 11 at the end of the shielded cable and the corresponding first and second terminals 30, 55 are connected on the terminal blocks 26 in the housings 20, 40 by tightening the bolts 27A. At the same time, the shield shell 60 is mounted to cover the connected housings 20, 40 and, as shown in FIG. 3, a total of three mounting portions 65, 66 and 97, i.e. the first and second mounting portions 65, 66 on the shell main body 61 of this shield shell 60 and the third mounting portion 97 on the shell cover 85 are arranged to form a triangle X having substantially equal sides and are connected to the upper surface of the first or second cases 11 or 12 by tightening the bolts 70A to 70C.

Electromagnetic wave noise generated from each insulated wire 50 in the shielded cable is absorbed by the shield shell 60 via the conductive layer (particularly the braided wire 51) and that generated in the housings 20, 40 such as at the end portion of the shielded cable is absorbed directly by the shield shell 60. These noises are transferred to the case 10 from the mounting portions 65, 66 and 97 at three positions.

The first terminals 30 of the shielded cable side and the second terminals 55 of the generator may have to be separated for maintenance. Thus, the bolt 90 is loosened to separate the shell cover 85 from the shell main body 61 and the bolt 70C is loosened to separate the mounting arm 95 of the shell cover 85 from the second case 12.

A mounted part of the cap 35 is exposed in this way, and the cap 35 can be removed to expose the work hole 34, as shown in FIG. 7. The bolts 27A screwed into the respective terminal blocks 26 are withdrawn through the work hole 34 to separate the first and second terminals 30, 55, and the screws 81 are loosened to remove the bracket 75.

The shielded cable is pulled in this state so that the second terminals 55 are pulled forward of the cavities 43 of the second housing 40 together with the bracket 75.

The first and second terminals 30, 55 can be reconnected by performing the above-described procedure in reverse.

As described above, electromagnetic wave noise generated in the insulated wires 50 and the housings 20, 40 is absorbed by the shield shell 60 and transferred to the case 10 from the mounting portions 65, 66 and 97 at three positions. The mounting portions 65, 66 and 97 are arranged at three positions to form a triangle having substantially equal sides. Thus, electromagnetic wave noise is transferred efficiently to the case 10 to obtain high shielding performance. Effective in noise removal as described has been confirmed by an experiment.

Specifically, shielding performance can be improved by making only a relatively simple structural change such as a change in the number and arrangement of the mounting positions of the shield shell 60 to the case 10.

The shield shell 60 comprises the shell main body 61 for covering the connected parts of the two housings 20, 40 and the shell cover 85 for covering the work hole 34 while partly overlapping this shell main body 61. The shell main body 61 and the shell cover 85 are joined by tightening the bolt 90 and the shell main body 61 includes the left and right mounting portions 65, 66 and the shell cover 85 includes one mounting portion 97. The mounting portions 65, 66 and 97 easily can be arranged to form a triangle having substantially equal sides.

The shell main body 61 and the shell cover 85 are formed separately and united by tightening the bolt 90. The shell main body 61 includes the positioning hole 69 and the shell cover 85 includes the positioning piece 92 to be fit into the positioning hole 69. Thus, an operation of assembling the shell main body 61 and the shell cover 85 at proper positions can be performed easily and precisely and an operation of tightening the bolt 90 can be performed reliably and efficiently by preventing the shell cover 85 from being rotated or displaced while tightening the bolt 90. As a result, an operation of integrally assembling the shield shell 60 can be performed quickly.

The cover main body 86 and the mounting arm 95 separately formed in advance are united, preferably by welding or soldering, to form the shell cover 85 and the cover main body 86 is joined to the shell main body 61 by tightening the bolt 90. The cover main body 86 is made of the thinner material (steel plate) than the mounting arm 95 and the mounting arm 95 is reinforced by being formed with the side walls 95A and/or the raised portion 98A. Therefore the cover main body 86 has relatively low flexural rigidity and the mounting arm 95 has relatively high flexural rigidity.

The case 10 is divided into the first and second cases 11, 12 and the mounting portions 65, 66 at two positions of the shell main body 61 of the shield shell 60 are fixed to the first case 11 and the mounting portion 97 at one position of the shell cover 85 is fixed the second case 12 by tightening the bolts 70A to 70C. Here, even if the height positions of the respective mounting surfaces of the first and second cases 11, 12 are displaced within a tolerance, the cover main body 86 having relatively low flexural rigidity takes up the tolerance while being deformed. On the other hand, although the mounting arm 95 has a long and narrow shape, it has strength to withstand vibration since having relatively high flexural rigidity.

The invention is not limited to the above described embodiment. For example, the following embodiments also are included in the scope of the invention.

The three mounting portions provided on the shield shell are ideally arranged to form an equilateral triangle. However, it has been confirmed by an experiment that the effect is comparable to the case of an equilateral triangle and electromagnetic wave noise can be transferred efficiently to the case if the mounting portions are arranged to form a triangle where a ratio of the longest side to the shortest side of which is about 1.8 or less.

The assembling procedure of the connector illustrated in the above embodiment is merely an example and can be changed appropriately.

The illustrated shell cover is formed by joining the separately formed cover main body and mounting arm, but it may be a unitary shell cover.

The shield shell has the shell main body and the shell cover in the illustrated embodiment, but it may be a unitary or integral shield shell made of conductive material such as aluminum die-cast.

The case for housing the device is divided in two in the above embodiment, but the invention can be applied in the case of a single case.

The invention can be applied to a device connector in a part connecting a motor and an inverter without being limited to the device connector in the part connecting the generator and the inverter of a hybrid vehicle as in the illustrated embodiment.

The invention can be applied widely to device connectors in general for connecting a terminal provided at an end of a shielded cable drawn out from a power supply or the like to a terminal of a device housed in a metal case.

What is claimed is:

1. A device connector to be connected to at least one terminal of a device housed in a conductive case, comprising:

a first housing accommodating at least one first terminal to be connected to the terminal of the device, the first terminal having a first connecting portion external of the case, the first housing having at least one work hole providing access to the first connecting portion; and a second housing accommodating at least one second terminal to be connected to an end of a wire, the second housing being connectable to the first housing, the second terminal having a second connecting portion, the first and second connecting portions of the corresponding first and second terminals being placed one over the other and bolted as the first and second housings are connected, the at least one work hole providing access to bolt the connecting portions of the terminals together; and a shield shell made of conductive material and arranged to at least partly cover the connected housings, three mounting portions being arranged on the shield shell for fixing the shield shell to the case by bolting.

2. The device connector of claim 1, wherein the three mounting portions are arranged on an outer edge part of the shield shell to form a triangle, a ratio of a longest side to a shortest side of the triangle being about 1.8 or less.

3. A device connector to be connected to at least one terminal of a device housed in a conductive case, the device connector comprising:

a first housing accommodating at least one first terminal to be connected to the terminal of the device;

a second housing accommodating at least one second terminal to be connected to an end of a wire, the second housing being connectable to the first housing, connecting portions of the corresponding first and second terminals being placed one over the other and bolted as the first and second housings are connected, the first housing having at least one work hole used to bolt the connecting portions of the terminals together; and a shield shell made of conductive material and arranged to at least partly cover the connected housings, three mounting portions being arranged on the shield shell for fixing the shield shell to the case by bolting, wherein the shield shell has a shell main body for covering connected parts of the two housings and a shell cover for covering the work hole while partly overlapping the shell main body.

4. The device connector of claim 3, wherein the shell main body and the shell cover are joined by bolting.

5. The device connector of claim 3, wherein the shell main body has two of the mounting portions and the shell cover has one of the mounting portions.

6. The device connector of claim 3, further comprising convex/concave engaged positioning portions provided between the shell main body and the shell cover for positioning the shell main body and the shell cover and preventing the shell main body from rotating or displacing when bolting.

7. The device connector of claim 3, wherein the shell cover is made of a metal plate and is formed by integrally joining the cover main body and mounting portion by welding, the cover main body being made of a thinner material than the mounting portion.

8. The device connector of claim 7, wherein the mounting portion is reinforced by at least one side wall and at least one raised portion.

* * * * *